United States Patent [19]

Coggins

[11] Patent Number: 4,609,224

[45] Date of Patent: Sep. 2, 1986

[54] CHAIR TABLE

[76] Inventor: James P. Coggins, 3515 No. 64th Ave., Omaha, Nebr. 68104

[21] Appl. No.: 478,796

[22] Filed: Mar. 25, 1983

[51] Int. Cl.[4] ..... A47C 7/162

[52] U.S. Cl. ..... 297/188; 108/152

[58] Field of Search ..... 297/188, 194, 135, 162; 108/152, 135; 211/188

[56] References Cited

U.S. PATENT DOCUMENTS

| | | | |
|---|---|---|---|
| 2,447,391 | 8/1948 | Brandes et al. | 297/135 X |
| 3,025,103 | 3/1962 | Mohror | 108/135 |
| 3,042,467 | 7/1962 | Germick | 297/188 |
| 3,239,272 | 3/1966 | Wilkins | 297/194 |
| 3,367,714 | 2/1968 | Stone | 297/194 |
| 3,522,887 | 8/1970 | Petersen | 211/188 |
| 3,586,276 | 6/1971 | O'Mahoney | 297/194 |
| 4,357,881 | 11/1982 | DeLong | 108/135 |
| 4,449,750 | 5/1984 | Pultman | 297/188 |

*Primary Examiner*—Francis K. Zugel

[57] ABSTRACT

A chair table attachable to a tubular frame chair by means of clamps and supported only by the chair and having a horizontal portion supported by a vertical attachment portion which latter is connected to the tubular frame members by clamps and by engagement with the frame members below the clamps, in combination with a counter-weight attached to the opposite side of the chair. A modification having one of its clamps at a greater spacing from the vertical portion for attachment to a frame portion farther from the vertical portion.

19 Claims, 8 Drawing Figures

CHAIR TABLE

BACKGROUND OF THE INVENTION

A table for attachment to a lawn chair is described in U.S. Pat. No. 3,894,496, issued July 15, 1975, to James F. Phillips and Robert H. Shipley, entitled and titled: FOLDING LAWN CHAIR TABLE.

To reach a large market a table for such a purpose must be inexpensive,and a folding, telescoping leg, such as in the patent, has much cost and a construction involving many assembled peices also is very costly.

An objective hereof is to provide a table having a horizontal portion and a vertical portion and in which clamps attached to the vertical portion grip portions of the frame of a chair at a substantial spacing above the lower edge of the vertical portion so that the clamps hold the vertical portion to the chair while the lower edge of the vertical portion prevents a downward pivoting of the outer edge of the table by engaging legs of the chair. With such a construction, a leg on the table is not needed.

Another objective is to provide a counter-weight attachable to the opposite side of a chair to counter-balance objects placed on the chair table to make the tipping over of the chair, when it is not occupied, to be unlikely, even though articles of considerable weight are rested on the table when attached to a lawn chair of light construction.

Another objective hereof is to provide such a counter-weight with a construction of a usefulness of its own such that it be itself able to support items, and one such use is that the counter-weight be an ashtray.

BRIEF DESCRIPTION OF THE DRAWINGS

In FIG. 4 a portion of the vertical section is shown to be perforate and this is used as a convenience of illustration to show that the vertical and horizontal sections could each be generally perforate, although it is to be understood that the entire horizontal and vertical sections of the chair table of this invention could also be imperforate as one modification, as in the illustrations of FIGS. 2 and 3.

FIG. 6 also shows a portion of a chair frame member against which the chair table is rested, but no clamps are shown.

DESCRIPTION OF THE PREFERRED EMBODIMENTS

Figure 1:
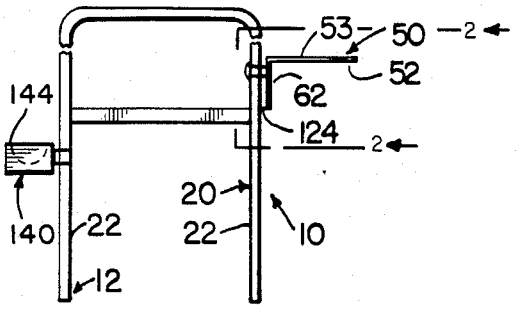
FIG. 1 is a frontal elevation of the chair having the chair table of this invention attached to one side thereof and having the counter-weight of this invention in the form of an ashtray attached to the other side thereof.

In FIG. 1 a chair table and chair assembly is generally indicated at 10 and has a chair indicated at 12 having a frame 20 having upright portions 22 on the right and left sides thereof.

Figure 2:
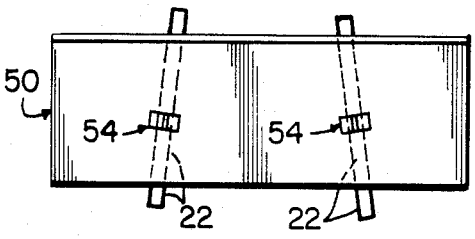
FIG. 2 is a sectional view taken along the line 2—2 of FIG. 1.

As best seen in FIG. 2, the upright portions 22 on the side of a lawn chair are seen to be two in number and are spaced apart forwardly and rearwardly from each other and are disposed inclining toward each other somewhat at their upper ends in the area immediately beneath the arm rest 30 on the same side of the chair, as seen in FIG. 1.

All parts of such lawn chairs are substantially symmetrical about a vertical plane extending from the center of the forward side of the chair through the center of the rearward side of the chair.

Such chairs are conventionally made of very light construction, such as aluminum frame with light thermoplastic interwoven bands forming the seat and the back covering portions. For that reason, they tip over easily when they are not occupied.

In accordance with this invention, a chair table generally indicated at 50 is attached to the frame members 22 by means of clamp assemblies generally indicated at 54.

Two clamp assemblies 54 are used, on e for attachment to each one of the two frame members 22 on the respective side of the chair.

The chair table 50 has an article-supporting generally horizontal section 52 having a substantial horizontal upper article-supporting surface 53.

An attachment section of the table is shown at 62 and is connected to the inner edge of and extends downwardly from the article-supporting section 52. The attachment section 62 and the article-supporting section 52 are sufficiently rigid that the attachment section 62, when held in an upright position,will support the article-supporting section 52 so that it can have its upper surface 53 substantially horizontal.

There are two clamp assembles 54, whcih can also be called holding assemblies 54, and each comprises a holding member or clamp 68, which latter has jaws 72 which press firmly against the sides of the respective frame member 22 which is received therein.

The frame member 22 is cylindrical and the jaws 72 that clamp are biased toward each other because the clamp is made of one piece of resilient thermoplastic material or of metal and the jaws 72 are interconnected by interconnecting portion 76 which fits against the inner side surface 78 of the attachment section 62.

Figure 4:
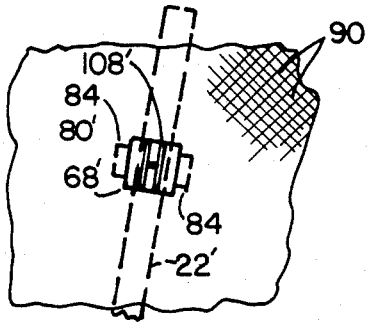
FIG. 4 a detail showing a part of an attachment section of a perforated modification of the chair table adjacent one of the clamps, as would be seen along the line 2—2 of FIG. 1, a portion of the chair frame held in the clamp being shown in dotted lines.

The interconnecting portion 76 of each clamp has a bolt 80 extending therethrough and each bolt 80 extends through a suitable opening in the attachment section 62 and through a washer 84 on th outer side of the attachment section 62. Such washers can be rectangular, as seen at 84 in FIG. 5. The outer end of each bolt 80 receives a nut 85 holding the washer and clamp firmly against respective sides of the attachment section 62 of FIG. 1 or 62' of FIG. 5. In the modification of FIG. 4, the attachment section 62' is provided with a plurality of perforations therethrough as seen at 90 and these perforations or openings 90 are generally distributed throughout the attachment section and it is to be understood that they are also generally distributed throughout the article-supporting section 52' of FIG. 4 since the sections 62' and 52' are made of one piece of material such as thermoplastic or metal material.

Figure 3:
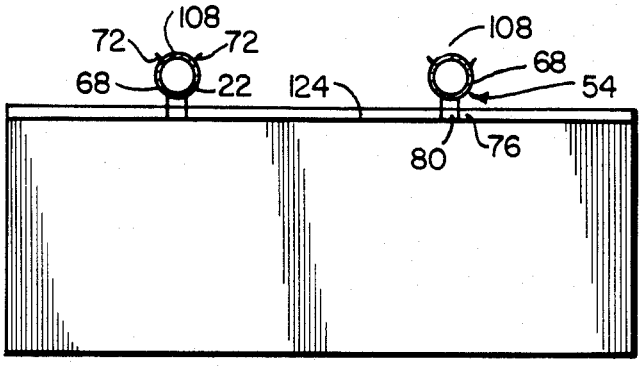
FIG. 3 is a top plan view of the chair table with its clamps attached and showing the clamps receiving therein portions of the frame of the chair with the remainder of the chair shown.

The article-supporting section 52 and the attachment section 62 of FIGS. 1, 2 and 3, however, are shown without perforations, since these sections could also be a single piece of imperforate material, such as metal or plastic. However, perforated material is preferred for two reasons. One reason is that the weight of the material is thereby lesser for reducing shipping costs and tendency to tip the light chair over. The second reason is that the perforated material has so many perforations and openings therethrough that the bolts 80 can be put through any one of them to easily fit the clamps into various positions for receiving the frame members of various types of chairs which might be in different positions themselves.

Figure 5:
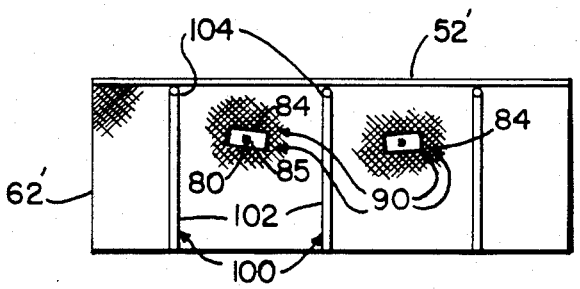
FIG. 5 a side elevation of a modification of the chair table of FIG. 1 as it would be seen from the right in FIG. 1, the modification being perforated, although this is illustrated only by a small amount of perforations for of illustration.

A plurality of braces can be attached to the table, each brace having a vertical section 102 attached to the outer side of the attachment section 62' of FIG. 5 or 62 of FIG. 1 and having a horizontal section 104 of one piece with the vertical section 102 and extending along the underside of and attached to the article-supporting section 52 or 52'.

The clamp jaws are seen to be spaced apart at 108 in FIG. 3 and at 108' in FIG. 4 so as to receive a frame member 22 therethrough.

The clamp in FIG. 4 is given prime numbers because it is on a modification in which the attachment section 62' has the perforations 90 therethrough.

A bolt 80' is shown in FIG. 4 holding the clamp 68' in place.

Figure 6:
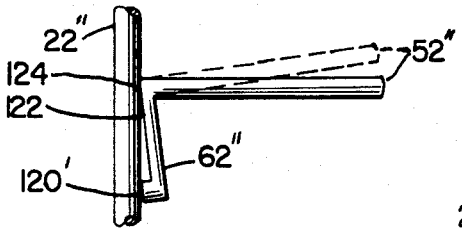
FIG. 6 is a frontal elevation of a modification of the table of FIG. 1 in which the substantially horizontal portion is shown horizontally in full lines, as it would be when loaded by articles, not shown, the dotted lines illustrating the position of the horizontal portion when there are no objects thereon.

In FIG. 6 a modified chair table is there shown having a horizontally extending article-supporting section 52'' which is shown in full lines in exact horizontal position such as it would be in after it has been weighted down with substantial articles not shown. However, the article-supporting section 52'' is shown in dotted lines in FIG. 6 in an upper position in which it would be in when it is not loaded. This is because the article-supporting section 52'' is springy or resilient and bends down under load.

In FIG. 6 the attachment section is shown at 62'' and has a projection 120 at its lower end on its inner side 122 facing a frame member 22'', whereby when the upper edge of the inner side 122 is in engagement with the frame member 22'', as seen at 124 and the projection 120 is in engagement with the same frame member 22'', then the article-supporting section 52'' will be in the positions described respectively.

In FIG. 1 on the opposite side of the chair from the chair table 50 is a counter-balance assembly 140 which can be formed of a weighting member which can be an ashtray which is attached by a clamp 146 similar to the clamps 68 to a frame member 122, whereby the counter-weight 140 will counter-balance the chair table 50 when the chair is not being sat in. The counter-weight 140 will be heavier than the chair table 50 so that when the chair table 50 is supporting a glass of liquid beverage, for example, it will be counter-balanced by the counter-weight 140.

Figure 7:
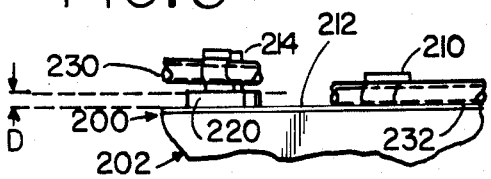
FIG. 7 is a top plan view of a modification of the table of FIG. 3, but in which one of the clamps is spaced outwardly from the vertical portion of the table a substantial distance by means of a spacing block so that the chair table is adapted to work with a chair frame of a type having frame members that are in different vertical planes, small segments of such frame members being shown.
Figure 8:
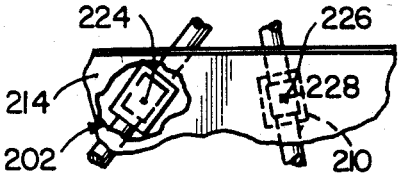
FIG. 8 is a side elevation of the chair table of the modification of FIG. 7 as it would be seen as though it were from the right in FIG. 1, but of the modification of FIG. 7. The two chair fram members to which the table of FIG. 8 is attached are shown in partially in full and partially in dotted lines. A section of the vertical portion of the chair table is broken away in FIG. 8 to show a spacing block therebehind, dotted lines showing the clamps.

Referring to FIG. 7 a modification of the invention is there shown in which a chair table and chair assembly is generally indicated at 200 and in which the table, generally indicated 202, can be like the table 50 of FIG. 1 with the clamp 110 at the right side of FIG. 7 being directly against the adjacent side 212 of the vertical portion 214 of the chair table, as seen in FIG. 8, but also in FIG. 7. However, the clamp at the left side in FIGS. 7 and 8 is spaced a substantial distance from the adjacent side 212 of the chair table and a spacing block or spacer 220 is disposed between the clamp 214 at the left-hand side and the adjacent surface 212 of the table.

As best seen in FIG. 8, bolts 224 and 226 extend through the clamps 214 and 210 and through the vertical portions of the chair table 214 and having nuts 228 on the opposite side of the vertical portion 214 from the clamps. Only one of the nuts 228 is shown in FIG. 8, however.

Two chair frame segments 230 and 232 are seen to be disposed in the clamps 214 and 210 respectively and the segments 230 and 232 incline with respect to each other toward each other at their upper ends, but are offset with respect to each other, as seen in top plan view in FIG. 7. Frame segments to which a chair table would be attached are in this position on some kinds of chairs and the spacer 220 has been found very effective in such uses. It will be seen that, since the perforations, or holes, or openings 90 are generally distributed throughout the attachment section 62', that therefore, it can be said that there are at least four holes 90, or at least eight holes, or at least ten holes, etc., in the attachment section 62' through which the bolts 80' can extend. And, therefore, it can also be said that there are two of the holes 90 that are spaced apart, both vertically and horizontally with respect to each other, for giving horizontally optional positions for the mounting of one holding member or clamp 68', and that a second two of the holes 90 are spaced apart, both vertically and horizontally with respect to each other, and are also spaced apart with respect to the first two holes for the mounting of a second holding member or clamp 68' in horizontally spaced optional positions. In this way, wide versatility of chair-fitting is made possible. It can be said that at least two of the holding members or clamps 68' are disposed at a substantial distance above the lower edge of the attachment section 62', whereby the projection 120' adjacent the lower edge of the attachment section 62' can engage the outer sides of the legs of a chair and assist the holding members 68' to hold the table from tipping downwardly at its outer end. In FIG. 7 the frame segment 230 can be considered to be extended outwardly from the respective side of the chair a lesser distance than the other frame segment or portion 232 by a certain difference in extending dimension. The spacer 220 extends outwardly from the vertical table portion 212 a distance equal to the dimensions D by which the frame segment or portion 230 extends outwardly from the chair beyond. The spacer 220 then extends away from the attachment section 212 of the table a distance which is preferably all, as shown, but at least a substantial part of the dimension D. The clamp 210 rests directly against the attachment section 212 whereas the clamp 214 does not.

I claim:

1. A chair table attachable to a chair having upwardly extending side frame portions, said table comprising: an article-supporting section having a substantially horizontal upper article-supporting surface, an attachment section connected to and upholding and extending downwardly from said supporting section and adjacent to one side of said supporting section, at least two horizontally spaced holding means having a cylindrical object receiving and holding capability, said holding means projecting from said one side of said attachment section, means connecting said holding means to said attachment section, said attachment section having at least four holes therethrough, said holding means connecting means extending through certain ones of said holes and being selectively extendable through various holes for ease of adjustment to chairs of varying frame shapes, two of said holes being spaced apart both vertically and horizontally with respect to each other for giving horizontally optional positions for the mounting of one of said holding means, a second two of said holes being spaced apart both vertically and horizontally with respect to each other and also being spaced apart horizontally with respect to said first two holes for the mounting of a second one of said holding means in horizontally spaced optional positions whereby wide versatility of chair fitting is made possible.

2. The chair table of claim 1 having said article-supporting section and said attachment section being formed integrally of the same piece of material.

3. The chair table of claim 2 having said material being thermoplastic material.

4. The chair table of claim 1 having said holding members each being a resilient clamp capable of yielding to open to receive a cylindrical chair frame member as said clamps are pressed onto a chair frame and capable of resiliently gripping cylindrical chair frame members of certain diameters which are held therein.

5. The chair table of claim 4 having said clamps each being made of one piece of thermoplastic material.

6. The chair table of claim 1 in combination with a chair having two upwardly extending cylindrical elongated frame portions on one side thereof and to which said holding means are attached.

7. The chair table of claim 6 having a counterweight attached to the opposite side of said chair to reduce probability of the chair tipping when no one is in it and articles are on said table.

8. The chair table of claim 1 having at least two of said holding means being disposed at a substantial distance above the lower edge of said attachment section, whereby means fixed to said attachment section and adjacent said lower edge can engage the outer sides of the legs of a chair and thereby assist the holding means to hold said table from tipping downwardly at its outer end.

9. The chair table of claim 1 having brace means attached to said attachment section and supporting the underside of said article supporting section.

10. The chair table of claim 1 having a projection means extending horizontally outward from said attachment section for engaging the outer sides of legs of a chair.

11. The chair table of claim 1 having said projection means being horizontally elongated.

12. The chair table of claim 1 having said holes being at least 6 holes.

13. The chair table of claim 1 having said holes being at least 8 holes.

14. The chair table of claim 1 having said holes being at least 10 holes.

15. A chair table attachable to a chair having upwardly extending side frame portions, said table comprising: an article-supporting section having a substantially horizontal upper article-supporting surface, an attachment section connected to and upholding and extending downardly from said supporting section and adjacent to one side of said supporting section, at least two horizontally spaced holding means having a cylindrical object receiving and holding capability, said holding means projecting from said one side of said attachment section, means connecting said holding means to said attachment section, said attachment section having at least eight holes therethrough, said holding means connecting means extending through certain ones of said holes and being selectively extendable through various holes for ease of adjustment to chairs of varying frame shapes, two of said holes being spaced apart both vertically and horizontally with respect to each other, a second two of said holes being spaced apart both vertically and horizontally with respect to each other and also being spaced apart horizontally with respect to said first two holes, and having a further two of said holes being spaced apart both vertically and horizontally with respect to each other, and a still further two of said holes being spaced apart both vertically and horizontally with respect to each other and also being spaced apart horizontally with respect to said first two holes.

16. A chair table attachable to a chair having upwardly extending side frame portions, said table comprising: an article-supporting section having a substantially horizontal upper article-supporting surface, an attachment section connected to and upholding and extending downwardly from said supporting section and adjacnet to one side of said supporting section, at least two horizontally spaced holding means having a cylindrical object receiving and holding capability, said holding means projecting from said one side of said attachment section, means connecting said holding means to said attachment section, said attachment section having at least six holes therethrough, said holding means connecting means extending though certain ones of said holes and being selectively extendable through various holes for ease of adjustment to chairs of varying frame shapes, a first two of said holes being spaced apart horizontally with respect to each other, a second two of said holes being spaced apart horizontally with respect to each other and also spaced apart horizontally with respect to said first two holes, a third two of said holes being spaced apart horizontally with respect to each other and spaced vertically with respect to said first two holes.

17. The chair table of claim 16 in which the number of said holes is sufficient to be spread over at least one-eighth of said attachment section.

18. The chair table of claim 16 in combination with a chair having two upwardly extending elongated frame portions on one side thereof and to which said holding means are attached, one of said frame portions extending outwardly from the respective side of said chair a lesser distance than the other of said frame portions by a certain difference in extending dimensions, a spacer disposed between said attachment section and one of said elongated frame portions, and spacer extending away from said attachment section a distance which is at least a substantial part of said dimension.

19. The chair table of claim 16 having said hoels being sufficient to be spread through the majority of the entire area of said supporting section.

* * * * *

UNITED STATES PATENT AND TRADEMARK OFFICE

CERTIFICATE OF CORRECTION

PATENT NO. : 4,609,224

DATED : September 2, 1986

INVENTOR(S) : James P. Coggins

It is certified that error appears in the above-identified patent and that said Letters Patent is hereby corrected as shown below:

The term of this patent subsequent to October 2, 2002 has been disclaimed.

This certificate supersedes Certificate of Correction issued June 23, 1987.

Signed and Sealed this

Twenty-second Day of September, 1987

*Attest:*

DONALD J. QUIGG

*Attesting Officer* *Commissioner of Patents and Trademarks*